US007210711B2

(12) United States Patent
Dirnberger et al.

(10) Patent No.: US 7,210,711 B2
(45) Date of Patent: May 1, 2007

(54) DOOR LOCK

(75) Inventors: Albert Dirnberger, Neunburg v.W. (DE); Georg Spiessl, Willhof (DE)

(73) Assignee: Emz-Hanauer GmbH & Co. KGAA, Nabburg (DE)

( * ) Notice: Subject to any disclaimer, the term of this patent is extended or adjusted under 35 U.S.C. 154(b) by 0 days.

(21) Appl. No.: 09/993,200

(22) Filed: Nov. 6, 2001

(65) Prior Publication Data

US 2002/0073752 A1 Jun. 20, 2002

(30) Foreign Application Priority Data

Dec. 1, 2000 (EP) ..... 00126304

(51) Int. Cl.
*E05C 3/16* (2006.01)

(52) U.S. Cl. ..... 292/68; 292/223; 292/DIG. 57

(58) Field of Classification Search ..... 292/202, 292/216, 59, 66, 68, 220, 222, 223, DIG. 69, 292/DIG. 49, DIG. 57, 120, 102, 218, 203
See application file for complete search history.

(56) References Cited

U.S. PATENT DOCUMENTS

| | | | | | |
|---|---|---|---|---|---|
| 2,138,251 | A | * | 11/1938 | Lindstrom | 292/198 |
| 2,158,983 | A | * | 5/1939 | Knoll | 292/174 |
| 2,169,535 | A | * | 8/1939 | Marple | 292/165 |
| 2,240,400 | A | * | 4/1941 | Johnson | 292/335 |
| 2,349,301 | A | * | 5/1944 | Overby | 292/2 |
| 2,833,578 | A | * | 5/1958 | Burke | 292/71 |
| 3,244,830 | A | * | 4/1966 | Bates | 200/61.68 |
| 3,328,062 | A | * | 6/1967 | Geiger | 292/123 |
| 3,670,537 | A | * | 6/1972 | Horgan | 70/120 |
| 4,497,513 | A | * | 2/1985 | Sasaki | 292/217 |
| 4,576,405 | A | * | 3/1986 | Wartian | 292/191 |
| 4,913,476 | A | * | 4/1990 | Cook | 292/196 |
| 4,997,221 | A | * | 3/1991 | Tolle et al. | 292/275 |
| 5,305,969 | A | * | 4/1994 | Odell | 244/129.5 |
| 5,440,103 | A | * | 8/1995 | Martin | 219/413 |
| 5,642,909 | A | * | 7/1997 | Swan et al. | 292/39 |
| 6,106,032 | A | * | 8/2000 | Och | 292/207 |
| 6,155,616 | A | * | 12/2000 | Akright | 292/207 |
| 6,290,270 | B1 | * | 9/2001 | Spiessl | 292/226 |

FOREIGN PATENT DOCUMENTS

| | | | |
|---|---|---|---|
| DE | 4317135 | C1 | 9/1994 |
| DE | 19504796 | A1 | 8/1996 |
| DE | 19540843 | A1 | 5/1997 |
| DE | 19837248 | A1 | 2/2000 |
| GB | 2133455 | A | 7/1984 |
| GB | 2193525 | A | 2/1988 |

* cited by examiner

*Primary Examiner*—Gary Estremsky
(74) *Attorney, Agent, or Firm*—Woodard, Emhardt, Moriarty, McNett & Henry LLP

(57) ABSTRACT

The solution according to the invention is based upon the knowledge that the undesirable hysteresis of the force-path function in door locks (1) can be avoided or at least minimised if the (frictional) forces acting during transitions from open positions to closed positions and vice versa are minimised and/or avoided. In this respect, the invention is based upon the starting point of at least reducing (frictional) forces acting in bearings for rotatable components (14, 18, 28) of door locks (1) and/or between surfaces (22, 30) displaceable relative to one another. In this manner, it is attained that forces required for a transition from a closed position to an open position essentially correspond to forces required for a transition from the open position to the closed position.

1 Claim, 8 Drawing Sheets

FIG. 2A
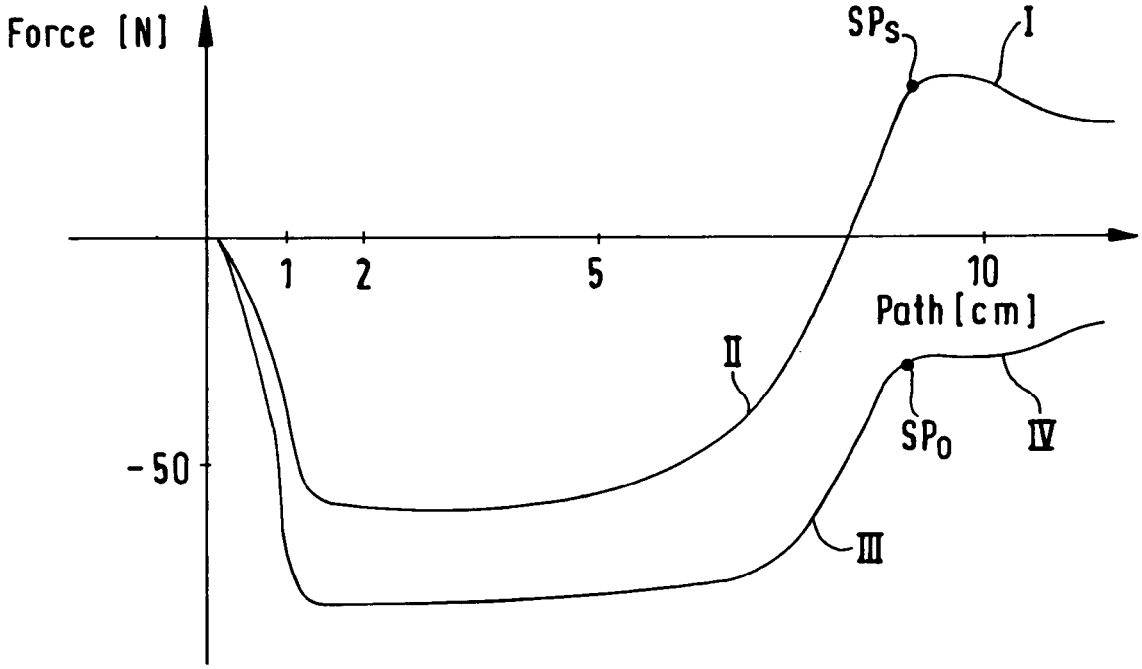
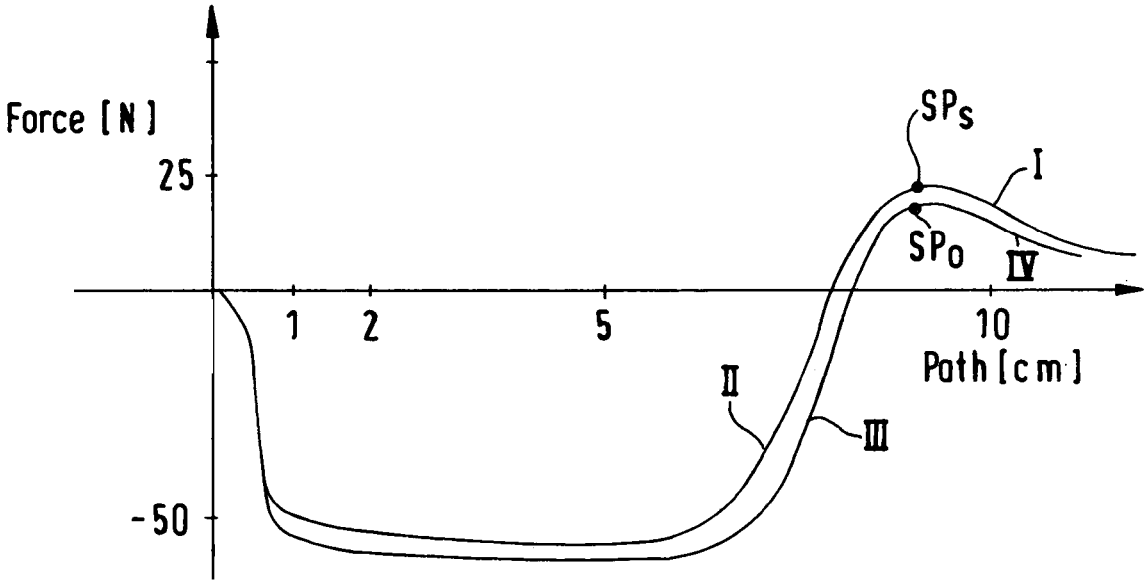
FIG. 2B

FIG. 3A
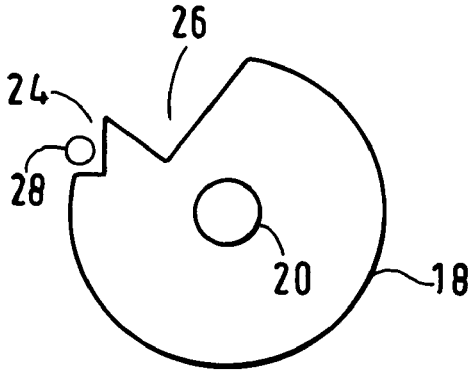
FIG. 3B
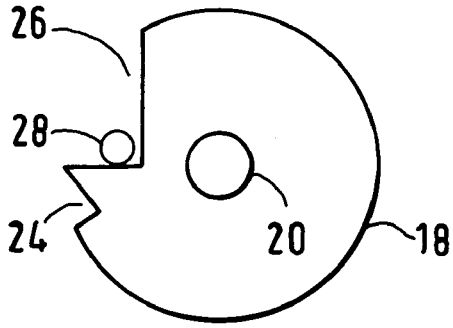
FIG. 4A
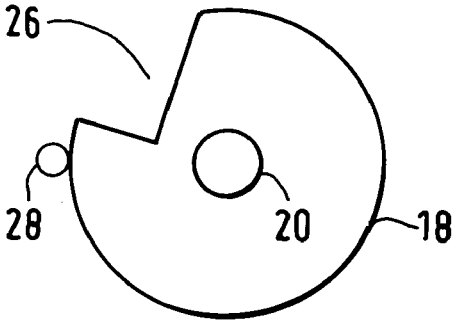
FIG. 4B
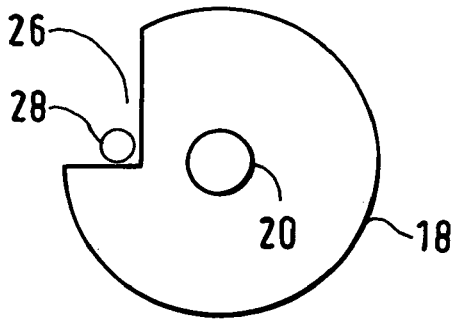
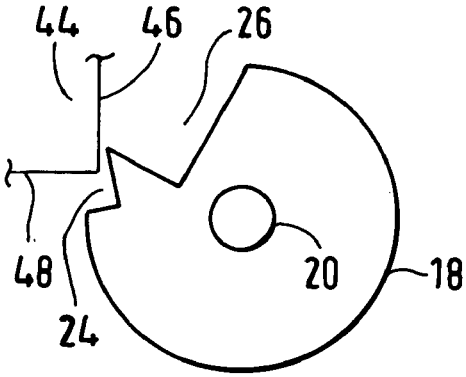
FIG. 5A
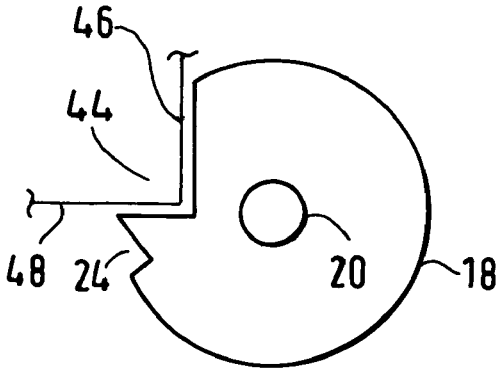
FIG. 5B FIG.7A
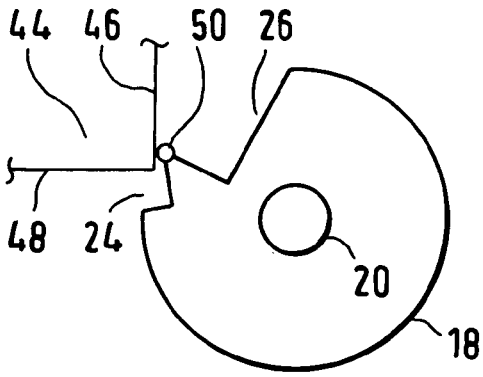
FIG.7B
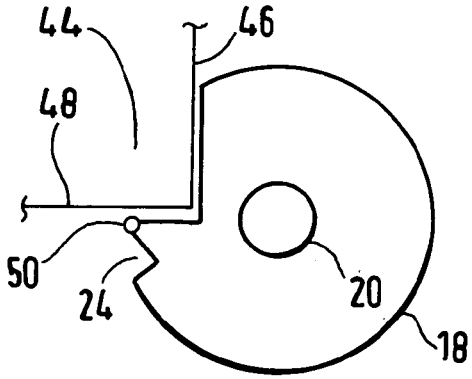
FIG.8A
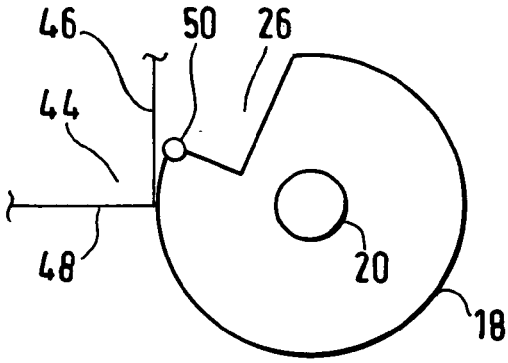
FIG.8B
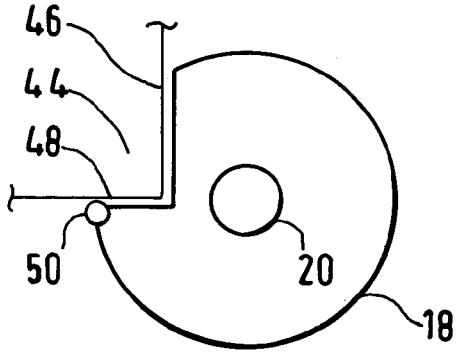
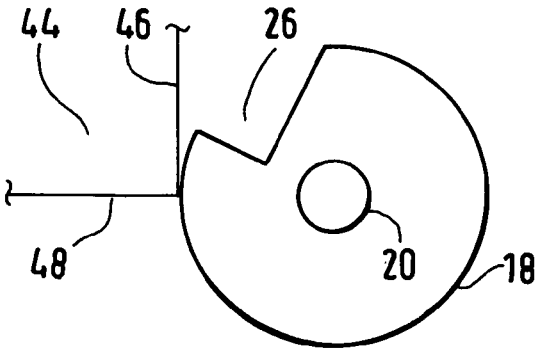
FIG.6A
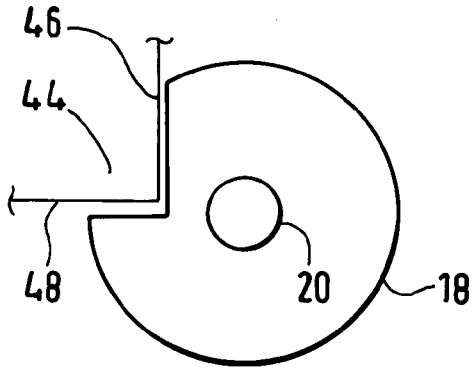
FIG.6B

DOOR LOCK

DESCRIPTION

1. Field of the Invention

The present invention relates to a door lock for electrical household appliances, such as washing machines, dishwashers and tumble driers, for example. In particular, the present invention relates to a door lock for electrical household appliances in which the acting forces required for opening and closing the door lock for full opening and closing procedures of an appliance door essentially correspond to one another.

2. State of the Art

A disadvantage in known door locks for household appliances, as are described, for example, in DE 195 40 843 C2 and DE 198 37 248 C2, is that the forces required for a full opening procedure of an appliance door (i.e. a transition of the door lock from the closed position to the open position) are greater than the forces required for a closure (i.e. a transition from the open position to the closed position).

The different forces for opening and closing the door lock result, amongst other things, from the fact that appliance doors of electrical household appliances are usually prestressed in an open state, i.e. in the open position of the door lock, in such a manner that the appliance door and therefore the door lock close automatically. If the angle of opening falls short of a predetermined angle of opening for the appliance door, so that a snap point for the door lock is reached, closing forces are generated by the door lock, which suffice to fully close the appliance door without any forces having to be applied by a user. Furthermore, in the closed position of the door lock, i.e. in the closed state of the appliance door, a large force is usually present in order to reliably lock the appliance door. These holding-shut forces existing in the closed position are typically so great that a door seal for the appliance door is compressed, in order to prevent, for example, the undesirable escape of water in the case of washing machines and dishwashers or heated air in the case of tumble driers.

When opening the appliance door, a user is required to apply forces in order to overcome the holding-shut and closing forces of the door lock, until the snap point is reached.

A disadvantage here is that a force-path function results for the forces acting upon the door lock, which comprises a hysteresis at least for the closing and holding-shut forces, which are generated by the door lock during the closing procedure after overcoming the snap point, and for the forces which need to be applied by the user during the opening procedure until the snap point is reached. Since the closing and holding-shut forces generated by the door lock are great, as described above, an opening of the appliance door is uncomfortable for a user.

A further disadvantage consists in that the force-path function generally comprises a hysteresis over the entire opening and closing paths, which are normally of equal length. This means that forces need to be applied by a user even after overcoming the snap point of the door lock in order to achieve a full opening procedure.

In order to remedy this problem, it is known to use a servomotor, which is activated prior to opening the door lock and which, as a result of the forces which it supplies, allows for a reduction in the opening forces which need to be applied by a user. This structurally complex and expensive solution is susceptible to faults, since the servomotor and components required for its operation need to be arranged in an appliance door together with the door lock. Consequently, incorrect closing procedures of the appliance door ("slamming" of the appliance door) can result in damage. Furthermore, this arrangement increases the weight of the appliance door and as a consequence of the additional space requirement can result in increased dimensions of the appliance door. Accordingly, this solution is not suitable for appliance doors in which the weight and/or the dimensions are to be minimised.

OBJECT OF THE INVENTION

It is the object of the present invention to provide a door lock whose force-path function for forces acting on the door lock does not exhibit a hysteresis or at least exhibits a minimised hysteresis for at least those sections in which forces need to be applied by a user during an opening procedure.

BRIEF DESCRIPTION OF THE INVENTION

The solution according to the invention is based upon the knowledge that in door locks, as are known for example from DE 195 40 843 C2 and DE 198 37 248 C2, the above-described undesirable hysteresis of the force-path function can be avoided or at least minimised if the (frictional) forces acting during transitions from open positions to closed positions and vice versa are minimised and/or avoided. In this respect, it is the object of the present invention to at least reduce (frictional) forces acting in bearings for rotatable components of door locks and/or between surfaces displaceable relative to one another. In this manner, it is attained that forces required for a transition from a closed position to an open position essentially correspond to forces required for a transition from the open position to the closed position.

Proceeding from the door lock according to DE 198 37 248 C2, the present invention provides a door lock with a contact region and a gripping device, which comprises an active region. The active region is shaped in such a manner that, in combination with the contact region, the active region holds the gripping device and therefore the door lock in an open position and a locked position. Furthermore, the gripping device and in particular the active region are shaped in such a manner that the gripping device, which in the open position contacts the contact region, loses contact with the contact region during a transition from the open position to the closed position, and during a transition from the closed position to the open position the contact is produced (again).

According to the invention, the contact region and/or the active region are constructed in such a manner that the forces required in order to effect a transition from the closed position to the open position essentially correspond to forces required for a transition from the open position to the closed position.

As will be explained in the following, this is attained in that the friction occurring between the contact region and the active region and the forces resulting therefrom are minimised at least during a transition from the closed position to the open position. Preferably, a comparable reduction in friction occurring during transitions from the open position to the closed position and forces resulting therefrom is also provided. Thus, frictional forces occurring during a transition from the closed position to the open position are attained, which essentially correspond to frictional forces occurring during a transition from the open position to the closed position.

The contact region can be provided on a circumferential line of a rotatably mounted axle or on a circumferential line of a bearing fitted so as to be rotatable relative to an axle. The minimisation of the friction obtained as a result of the rotatable characteristic of the axle or the bearing can be improved by a suitable selection of the surface composition of the contact region and/or of the active region.

The desired minimisation of friction can also be attained by means of a device in the active region which is rotatable by contact with the contact region. To this end, one or more bearings (e.g. roller bearings, anti-friction bearings) can be fitted in the active region, which are rotated upon contact with the contact region and thereby minimise the friction between the corresponding regions of the active region and contact region.

In addition, a desirable force-path function for the door lock is obtained if the contact region and/or the gripping device are displaced relative to one another during a transition from the closed position to the open position in such a manner that the function provided by the contact region and the active region in order to maintain the closed position is lifted and resulting frictional forces between the contact region and the active region are minimised or prevented.

An example of the above is a door lock in which the gripping device is rotatable and comprises a recess and in which the contact region is provided on a circumferential line of a rotatably mounted axle. In the closed position, the axle is arranged in the recess and preferably contacts said recess in order to securely hold the door lock in the closed position.

In order to open the door lock, i.e. for a transition from the closed position to the open position, the gripping device and/or the axle are displaced relative to one another in such a manner that the axle moves away from the gripping device at least in the region of the recess and is preferably removed from the region of the recess. In this manner, at least the friction and (contact) forces acting between the axle and the gripping device for transitions from the closed position are avoided.

In this respect, it is also possible to move the axle and/or the gripping device in such a manner that, during the transition from the closed position to the open position, forces acting between the contact region (axle) and the active region are (substantially) reduced. In this case, contact between the contact region (axle) and the active region is provided.

Furthermore, it is provided that the contact region and/or the gripping device are displaced relative to one another for a transition from the open position to the closed position in such a manner that the contact of the active region and the contact region for the open position is lifted.

If the gripping device is a gripping device rotatable about an axle, it is possible, as an alternative or supplement to the solutions stated above, to use a bearing arranged between the axle for the gripping device and the said gripping device in order to obtain the desired force ratios.

The use of a bearing between an axle of a pivotable closing lever, which is used for pivoting the gripping devices, also represents a solution according to the invention.

Proceeding from DE 195 40 843 C2, the invention provides a door lock in which a closing lever is mounted on a frame, which closing lever is pivotable back and forth between a closed position and an open position for the door lock. According to the invention, the mounting of the closing lever in the frame is designed in such a manner that the forces required during a transition from the closed position to the open position essentially correspond to forces required for a transition from the open position to the closed position.

Preferably, bearings (e.g. roller bearings, anti-friction bearings, ball bearings) are used to this end, which are arranged between the closing lever and the frame and are fitted, for example, on axle journals of the closing lever and/or bearing bores of the frame.

Alternatively or in addition to the above, the desired force ratios can be obtained for transitions from the stated positions for the door lock if a tensioning lever pivotably mounted on the frame is accordingly mounted. To this end, roller, ball and anti-friction bearings and other types of bearing can be arranged between the frame and the tensioning lever, which are fitted, for example, on axle journals of the tensioning lever and/or in bearing bores of the frame.

In a door lock of this type, a steering rod, which is hingedly connected to the closing lever at one end and at the other end is guided on the tensioning lever, is preferably connected to the closing lever in such a manner that frictional forces occurring during transitions from the closed position to the open position and during reverse transitions are minimised. A reduction in frictional forces of this type can be obtained by arranging anti-friction bearings, ball bearings or the like on axle journals of the steering rod and/or in bearing bores of the closing lever.

A further improvement can be obtained if the forces occurring during the guidance of the steering rod on the tensioning lever during actuation of the door lock are reduced. In this respect, in cases where the guidance of the steering rod on the tensioning lever is effected by means of crankpins of the steering rod in a guide groove of the tensioning lever, it is possible to arrange a ball bearing, anti-friction bearing or the like on the crankpins of the steering rod.

BRIEF DESCRIPTION OF THE DRAWINGS

In the following description of preferred embodiments of the invention, reference is made to the attached drawings, in which:

FIG. 2*a* is a graph showing a force-path function of a door lock according to the state of the art, FIG. 2*b* is a graph showing a force-path function of the door lock according to the invention from FIGS. 1*a* and 1*b*, FIG. 3*a* is a schematic illustration of the embodiment of the gripping device according to the invention of FIG. 1*a* in the open position, FIG. 3*b* is a schematic illustration of the embodiment of the gripping device according to the invention of FIG. 1*b* in the closed position, FIGS. 4*a*, 4*b* to FIGS. 8*a*, 8*b* are schematic illustrations of further embodiments of gripping devices according to the invention in the open position (a) and in the closed position (b)

DESCRIPTION OF PREFERRED EMBODIMENTS

Figure 1A:
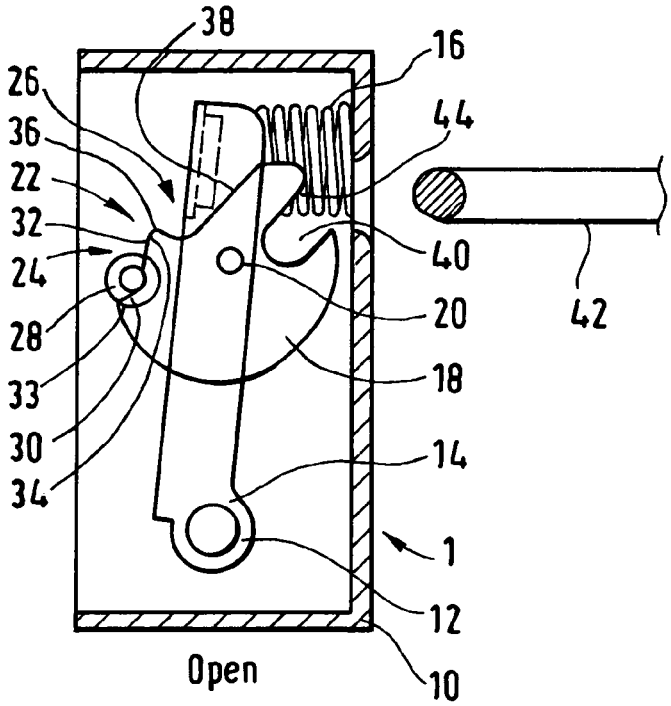
FIG. 1*a* is a schematic illustration of an embodiment of a door lock according to the invention in the open position.

The door lock 1 shown in FIG. 1*a* in an open position comprises a securing device 10 for receiving the components of the door lock 1 described in the following. The securing device 10 may be a stand, a frame or a housing, for example. Arranged in the securing device 10 so as to be pivotable about an axle 12 is a closing lever 14. In the illustrated open position, a closing spring 16 is tensioned between the end of the closing lever 14 opposite the axle 12 and the securing device 10 in such a manner that the closing lever 14 is forced in an anti-clockwise direction in FIG. 1*a*.

A gripping device 18 described in detail in the following is accommodated so as to rotate about an axle 20. The axle 20 is arranged between the end of the closing lever 14 contacting the closing spring 16 and the end of the closing lever 14 connected to the axle 12. A torsion spring, not shown here, is connected to the gripping device 18 and exerts forces upon the gripping device 18 in order to at least support rotations of the gripping device 18 in a clockwise direction according to FIG. 1, as will be described below, or to exert rotary forces upon the gripping device 18 in a clockwise direction.

In an active region 22, the gripping device 18 comprises two recesses 24 and 26. The active region 22, or more precisely the recesses 24 and 26, are used to hold the gripping device 18 and therefore the door lock 1 in the open position shown in FIG. 1*a* and in a closed position shown in FIG. 1*b*.

In order to provide this function of the gripping device 18, an axle 28 is arranged on the securing device 10. The axle 28 is rotatable about its longitudinal axis by means of suitable bearings (not shown) fitted to the securing device 10.

The recess 24 is an eccentric indentation in the circumferential line of the gripping device 18. The recess 24 is dimensioned and shaped as a function of the outer circumference of the axle 28 in the region of the gripping device 18 in such a manner that it contacts regions of the outer circumferential surface of the axle 28 in the region of the gripping device 18 in the open position shown in FIG. 1*a* as a result of the force action of the closing spring 16. The outer circumferential region of the axle 28 at least partially contacting the recess 24 is referred to in the following as the contact region 30. Furthermore, the recess 24 comprises a sliding edge 32, which extends radially inwards away from the circumferential line of the gripping device 18 and describes an arc here around the axle 20. As will be described in the following, the sliding edge 32 is used to support the transition of the door lock 1 from the open position to the closed position and vice versa. The sliding edge 32 extends into an abutment edge 33, which here in the open position can act as an abutment for the axle 28. An abutment of this type can also be provided by an external abutment, which is not constructed on the gripping device 18, but separately therefrom and is arranged, for example, on the securing device 10.

Figure 1B:
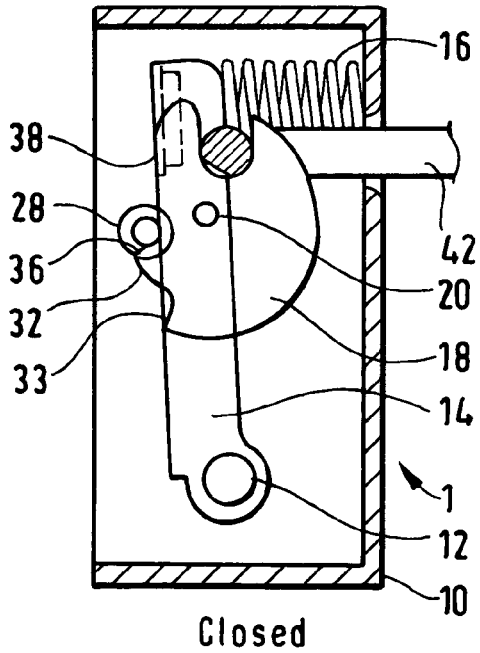
FIG. 1*b* is a schematic illustration of the embodiment of FIG. 1*a* in the closed position.

In order to bring the door lock 1 from the open position shown in FIG. 1*a* to the closed position shown in FIG. 1*b*, the gripping device 18 is rotated in an anti-clockwise direction according to these drawings. In so doing, the gripping device 18 slides with the sliding edge 32 along the axle 28, until the axle 28 reaches the radially outer end of the sliding edge 32. A further rotation of the gripping device 18 results in the axle 28 reaching a transition region 34 between the recesses 24 and 26, constructed here as a corner. This transition region, i.e. the corner 34, acts as a snap point, which means that the closing spring 16 can relax, so that the closing lever 14 rotates about the axle 12. In this respect, the gripping device 18 slides with a sliding edge 36 of the recess 26 along the outer circumference of the axle 28 disposed in the region of the gripping device 18, until the axle 28 reaches an abutment edge 38 of the recess 26. The sliding edge 36 extends radially inwards at an angle away from a tangent of the circumferential line of the gripping device 18 and extends into the abutment edge 38, which extends as far as the circumferential line of the gripping device 18. In order to press the sliding edge 36 and/or the abutment edge 38 against the axle 28, the above-mentioned torsion spring, not shown here, for the gripping device 18 can be used. The door lock 1 is now in the locked position shown in FIG. 1*b*.

In order to effect the above-described transition from the open position to the closed position, the gripping device 18 comprises a gripping latch 40. The gripping latch 40 is constructed as an eccentric indentation in the circumference of the gripping device 18. In the open position (FIG. 1*a*), the opening of the gripping latch 40 points in a direction in which it can receive a closing dog or closing hook 42 of an appliance door, not shown, which is to be closed by means of the door lock 1. In order to close the appliance door and therefore the door lock 1, the closing dog 42 is guided (for example by an opening, not indicated, appropriately arranged in the securing device 10) into the receiving region of the gripping latch 40, where it presses against a contact surface 44 and rotates the gripping device 18 in an anti-clockwise direction according to FIG. 1*a*. As a result of the rotation of the gripping device 18 caused by the closing dog 42 (and possibly as a result of the optional torsion spring), the above-described operation of the gripping device 18 is produced.

During the opening of the door lock 1, i.e. during a transition from the closed position (FIG. 1*b*) to the open position (FIG. 1*a*), the closing lever 14 is rotated in a clockwise direction about the axle 12, for example by using an opening lever, not shown, so that the closing spring 16 is compressed. The gripping device 18 thereby slides with the sliding edge 36 along the circumferential surface of the axle 28 disposed in the region of the gripping device 18 as far as the corner 34 acting as a snap point. Subsequently, the gripping device 18 is rotated in a clockwise direction, so that the gripping device 18 slides behind the corner 34 with the sliding edge 32 along the axle 28, until the latter is positioned in the recess 24 according to the open position. The rotation of the gripping device 18 can be obtained here by the removal of the closing dog 42 from the gripping latch 40, possibly together with a seal (not shown) forcing the housing door away, and/or by the above-mentioned torsion spring for the gripping device 18.

As mentioned at the beginning, the force-path function, which reproduces the forces acting upon the door lock 1, for a closure (i.e. a transition from the open position to the closed position) and a subsequent opening (i.e. a transition from the closed position to the open position) comprises a hysteresis. Consequently, the forces required during the transition from the open position to the closed position are less than the forces required during the transition from the closed position to the open position. A force-path function of this type is outlined by way of example in FIG. 2*a*, which illustrates a complete closing procedure in function sections I and II and a complete opening procedure in function sections III and IV.

In order to close the door lock 1, a user applies the forces reproduced by section I of the illustration function by means of the closing dog 42, until the snap point provided by the corner 34 and indicated here by $SP_s$ is reached. The closing spring 16 then relaxes, so that the door lock 1 is closed and held in the closed position. The forces generated in this respect are reproduced by the function curve II.

In order to open the door lock 1, the user needs to apply the forces reproduced by function section III in order to move the gripping device 18 and the closing lever 14, it being necessary to overcome the forces generated by the closing spring 16. As is clearly visible in FIG. 2*a,* the forces which need to be applied by a user and which are required for section III of the opening procedure are clearly greater than the forces which are applied by the door lock during the closing procedure in section II and which act as closing and holding-shut forces.

Amongst other things, this hysteresis results from the fact that a large closing force is provided in the closed position of the door lock 1 in order to securely lock the appliance door. This closing force is also usually dimensioned in such a manner that a seal for the appliance door is compressed in the closed position. Furthermore, the hysteresis of the force-path function also results from the fact that the appliance door is normally prestressed in such a manner that it closes automatically after a predetermined angle of opening, i.e. without the introduction of force by a user.

Once the snap point provided by the corner 34 and indicated in FIG. 2*a* by $SP_o$ is reached during the opening of the door lock 1, the user needs to apply further forces by means of the closing dog 42 in order to bring the gripping device 18 into its position required for the open position. The above-mentioned torsion spring for the gripping device 18 does not suffice to this end, since the forces acting upon the gripping device 18 as a result of contact with the axle 28 are too great. The forces which need to be applied by the user during this part of the opening procedure are reproduced by the function section IV. Consequently, a hysteresis also results for sections I and IV.

The hystereses of the force-path function for sections II and III as well as I and IV are now prevented by reducing the friction acting between the gripping device 18 and the axle 28 in such a manner that the forces which need to be applied during the transitions to the closed position and open position essentially correspond to one another.

As described above, the axle 28 is rotatably mounted. Consequently, during the transition from the open position to the closed position and during the transition from the closed position to the open position, the axle 28 rotates as a result of contact with the sliding edge 32, the corner 34 and the sliding edge 36.

As a result of the rotatability of the axle 28, the friction generated during movements of the gripping device 18 is not sliding friction, in contrast to the state of the art. Rather, the axle 28 rolls during movements of the gripping device 18 over the contacted surfaces of the recess 24, the corner 34 and the recess 26. Experimental tests have shown that the hysteresis of the force-path function described above is substantially prevented in this manner. A force-path function for a door lock according to the door lock illustrated in FIG. 1*a* and FIG. 1*b* is shown in FIG. 2*b*.

The sections of the function illustrated in FIG. 2*b* and designated by the references I, II, III and IV, reproduce the resulting forces for the sections of the closing and opening procedures described with reference to FIG. 2*a*. In this respect, it can be clearly seen that, as a result of the described friction reduction between the gripping device 18 and the axle 28, a hysteresis for the force-path function in sections II and III is substantially avoided.

Furthermore, as a result of the above-mentioned friction reduction, it is substantially unnecessary, upon reaching the snap point when opening the door lock 1, which is indicated in FIG. 2*b* by the reference $SP_o$, for the user to apply any force in order to bring the gripping device 18 into its position required for the open position of the door lock 1. The reduction in the forces acting between the gripping device 18 and the axle 28 also means that the torsion spring for the gripping device 18 is sufficient in order to bring the gripping device into its position for the open position of the door lock 1. In this manner, a hysteresis is also substantially avoided for sections I and IV.

The same result can be obtained if, instead of the rotatable axle 28, a non-rotatable axle is used, which in the region of the gripping device 18 comprises a bearing (e.g. anti-friction bearing) arranged on its outer circumference. In this embodiment, which is not illustrated, the gripping device 18 does not roll upon the axle 28, as described above, but upon the bearing.

A further optimisation of the door lock 1 is obtained if bearings, e.g. ball or anti-friction bearings, not shown in the drawings, are used between the axle 20 and the gripping device 18 and/or between the axle 12 and the closing lever 14.

As explained, force-path functions without or with minimised hysteresis are obtained if the frictional forces acting upon the gripping device 18 are reduced during transitions from the open position to the closed position and vice versa. Further exemplary embodiments, which result in a frictional force reduction of this type, will be explained in the following with reference to FIG. 3*a/b* to FIG. 8*a/b*. For the sake of clarity in these drawings, only the gripping device 18 in different embodiments is illustrated as well as the axle 28 or the devices fulfilling the function of the axle 28. As in FIGS. 1*a* and 1*b,* the drawings labelled with the addition "a" show the gripping device 18 in the open position, whilst the drawings labelled with the addition "b" show the gripping device 18 in the closed position.

For better understanding of the explanation of further embodiments, the gripping device 18 and the axle 28 according to the embodiment of FIG. 1 are schematically illustrated in FIG. 3.

As shown in FIG. 4, the recess 24 can be omitted, so that the active region 22 is substantially formed by the recess 26, the corner 34 and the circumferential line of the gripping device 18 adjacent the corner 34.

Instead of the axle 28, it is possible, as shown in FIGS. 5 and 6, to use an abutment element 44 connected to the securing device 10. The abutment element 44 comprises a first abutment surface 46 and a second abutment surface 48, which encompass the contact region 30. As described above, the first abutment surface 46 cooperates in the open position and during a transition from the open position to the closed position with the recess 24 and the corner 34. In corresponding fashion, the second abutment surface 48 cooperates with the corner 34 and the recess 26 in the closed position and during a transition from the closed position to the open position. As with the use of the axle 28, it is also possible in this case to dispense with the recess 24 (cf. FIG. 6).

The above-described reduction in the friction is obtained in these cases in that the first abutment surface 46 and/or the second abutment surface 48 and/or the recess 24 and/or the corner 34 and/or the recess 26 each comprise a surface composition which, considered alone or in cooperation with a corresponding other surface, ensures a suitable reduction in friction. A surface composition of this type of individual, several or all of the above surfaces can be attained, for example, by a suitable coating with materials which reduce the occurring frictional forces during movements of the gripping device 18. An additional improvement is obtained if the transition between the first abutment surface 46 and the second abutment surface 48 and/or the corner 34 has a rounded construction.

In the embodiments illustrated in FIGS. 7 and 8, the abutment element 44 or an axle, not indicated, are used, the gripping device 18 comprising a rotatable axle, an (anti-friction) bearing or the like in the region of the corner 34. A device of this type, indicated by the reference numeral 50, is to be arranged in the region of the corner 34 in such a manner that it is contacted and rotated by the abutment element 44 (or the axle) during transitions from the open position to the closed position and vice versa, so that a force-path function without or with minimised hysteresis is obtained as a result of the reduction in the occurring frictional forces.

In particular in the embodiment illustrated in FIG. 8, an additional reduction in friction is obtained if the device 50 of the gripping device 18 is used in combination with the rotatably mounted axle 28 according to FIG. 1, or, as described above, if bearings arranged on a non-rotatable axle are used.

As described above, the forces which usually need to be applied during opening of a door lock are greater than the forces which need to be applied during closure. A further solution for minimising the forces required during an opening procedure, i.e. a transition from the closed position to the open position, of a door lock, consists in preventing contact of the gripping device with a corresponding contact region during opening of the door lock.

The solution described in the following, in which the gripping device 18 is moved in a direction radial to its circumferential line during a transition from the closed position to the open position, is more complex than the solutions described above. This additional outlay can be advantageous if the embodiments described above do not reduce the frictional forces to a degree sufficient for the respective application and/or if the additional outlay is justified for the application in question (e.g. for reasons relating to safety, comfort, etc.).

In FIGS. 9*a* to 9*e,* the operating states (positions) of the gripping device 18 are schematically illustrated for a transition from the open position to the closed position and back to the open position. For the sake of simplicity, the abutment element 44 and the gripping device 18 are shown without the recess 24.

Figure 9A:
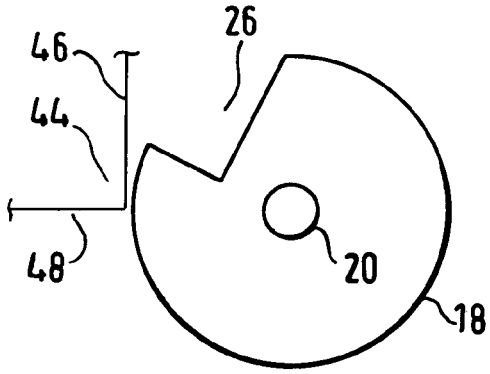
FIGS. 9*a* to 9*e* are schematic illustrations of states of an embodiment of a displaceable gripping device according to the invention.
Figure 9B:
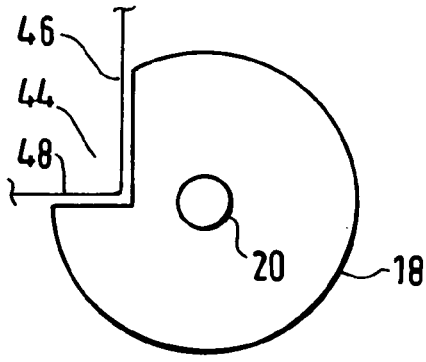

Proceeding from FIG. 9*a,* which shows the open position, the gripping device 18 is brought into the closed position illustrated in FIG. 9*b,* as described above. In this position, the abutment element 44 is located in the recess 26 and locks the door lock, not shown in FIG. 9, as a result of contact with the abutment edge 38 and/or with the sliding edge 36.

Figure 9C:
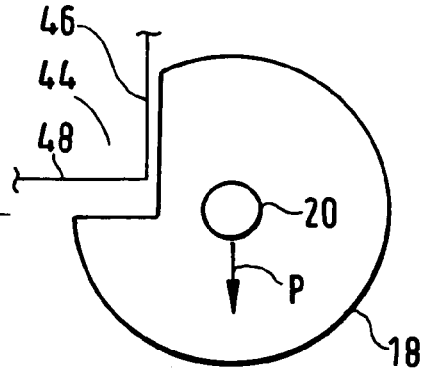
Figure 9D:
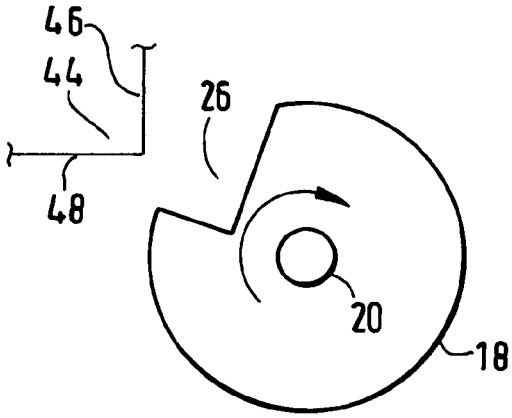
Figure 9E:
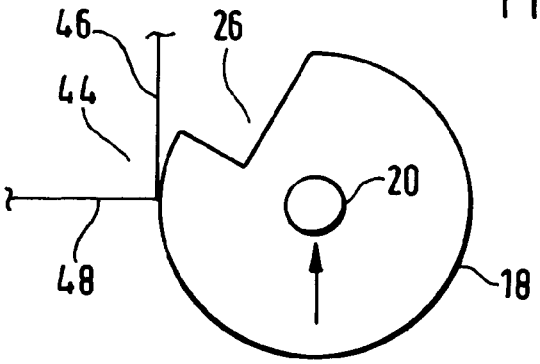

In order to open the door lock, i.e. to bring the door lock from the closed position to the open position, the closing lever 14 is rotated about the axle 12, as described above. In so doing, the gripping device 18 is moved in a direction radial to its circumferential line (i.e. in a direction perpendicular to the longitudinal axis of the axle 20). This direction of movement of the gripping device 18 is indicated in FIG. 9*c* by the arrow P. As an alternative to the vertically downwardly directed movement according to FIG. 9*c,* it is provided that the gripping device 18 is also moved in other directions in order to open the door lock 1, so long as the effect described in the following is obtained. Thus, the gripping device 18 can be moved linearly, for example, and/or non-linearly in directions with vertical and/or horizontal components of movement.

As is visible in FIG. 9*c,* as a result of the movement of the gripping device 18, its spatial position relative to the abutment element 44 is changed in such a manner that the reciprocal action between the abutment element 44 and the recess 26 desired in the closed position is not maintained. Rather, the change in spatial position of the gripping device 18, as described above, allows for a clockwise rotation for the open position. This is illustrated schematically in FIG. 9*d.*

During the rotation of the gripping device 18 or at the end of the rotary movement, when the gripping latch 40 allows for a removal of the closing dog 42, the gripping device 18 is moved back again into its starting position, which it adopts in the open position. The state of the door lock 1 shown in FIG. 9*e* corresponds to the open position illustrated in FIG. 9*a.*

These movements of the gripping device 18 during the opening of the locking device 1 mean that the gripping device 18 does not contact the abutment element 44 (or comparable devices) during a transition from the closed position to the open position, so that the forces which need to be applied in order to open the door lock 1 are reduced as a result of the lack of friction. This reduction prevents force-path functions with hysteresis. Depending on the respective application of this embodiment, more particularly the appliance door used in connection with this embodiment, the forces which need to be applied for opening can be thus reduced in such a manner that they are less than the forces which need to be applied for closure.

In order to move the gripping device 18 in the manner described above, a type of sliding block switch, for example, can be used, which is used to guide the axle 20 relative to the closing lever 14. Furthermore, it is provided that the axle 20 is guided in a slot arranged in the longitudinal direction of the closing lever 14 and that the movements of the gripping device 18 are generated by spring elements, which as a function of the respective position of the door lock 1 exert forces upon the gripping device 18 and/or the axle 20.

Figure 10A:
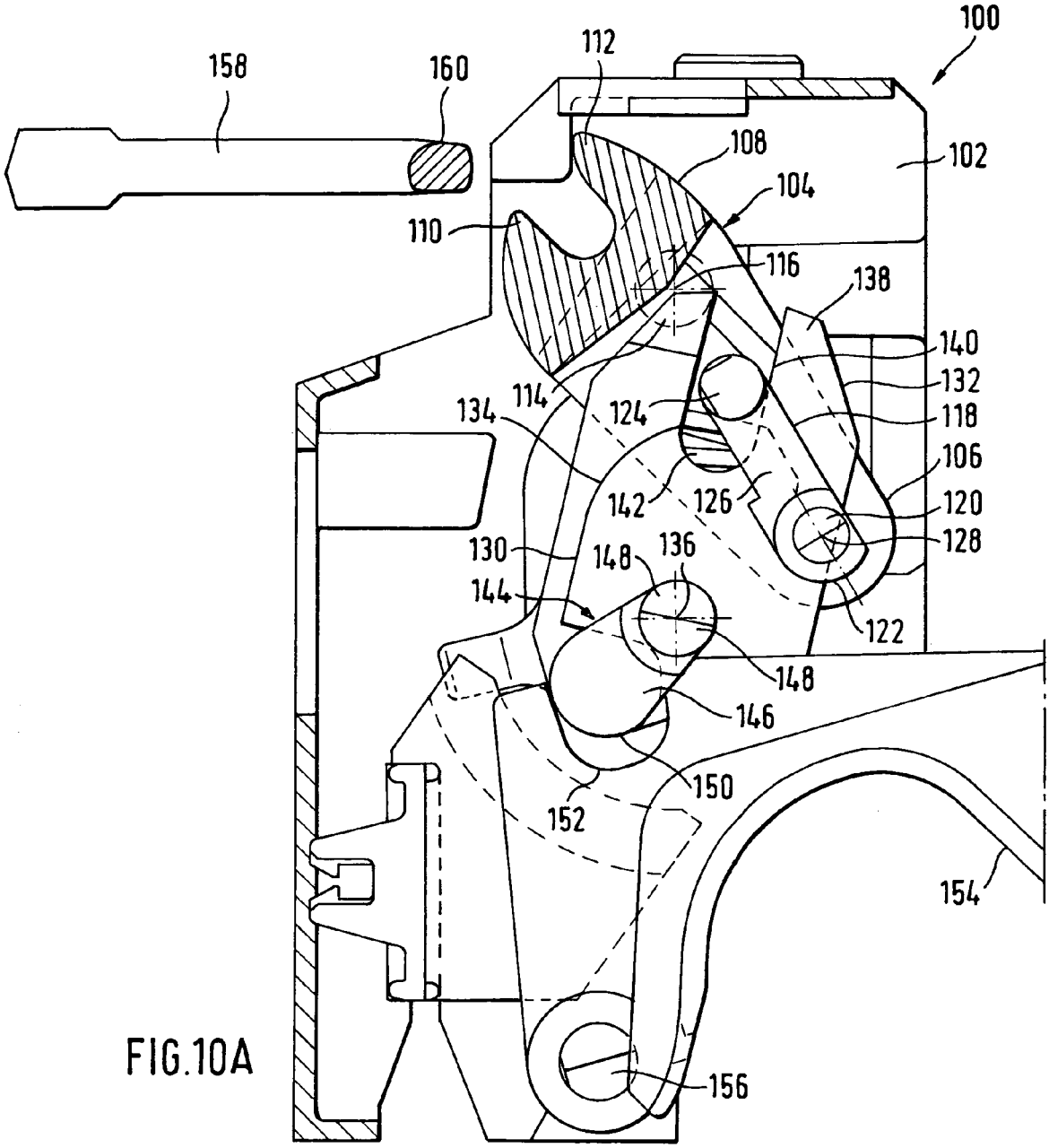
FIG. 10*a* is a schematic illustration of a further embodiment of a door lock according to the invention in the open position.
Figure 10B:
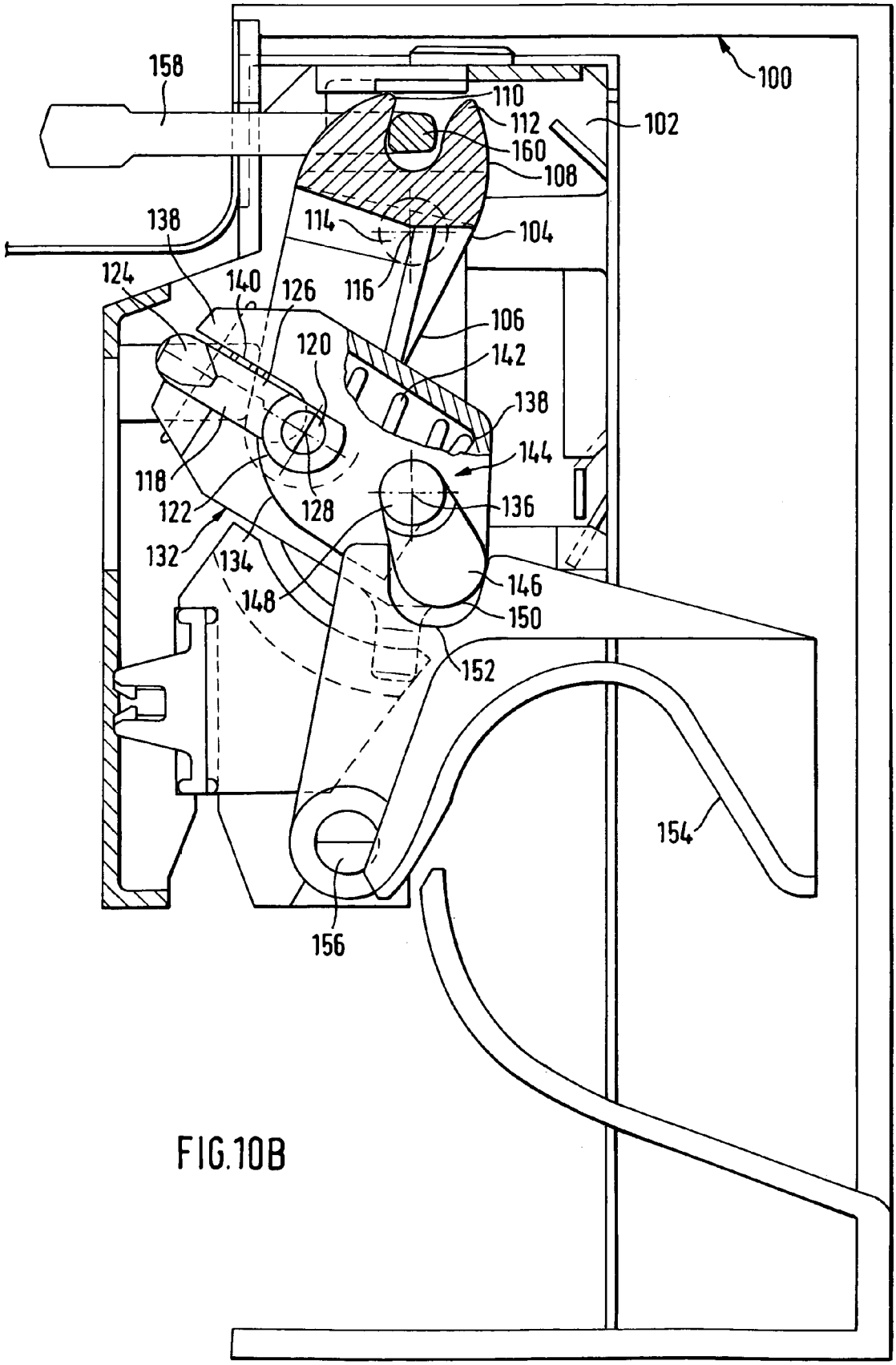
FIG. 10*b* is a schematic illustration of the embodiment of FIG. 10*a* in the closed position.
Figure 11:
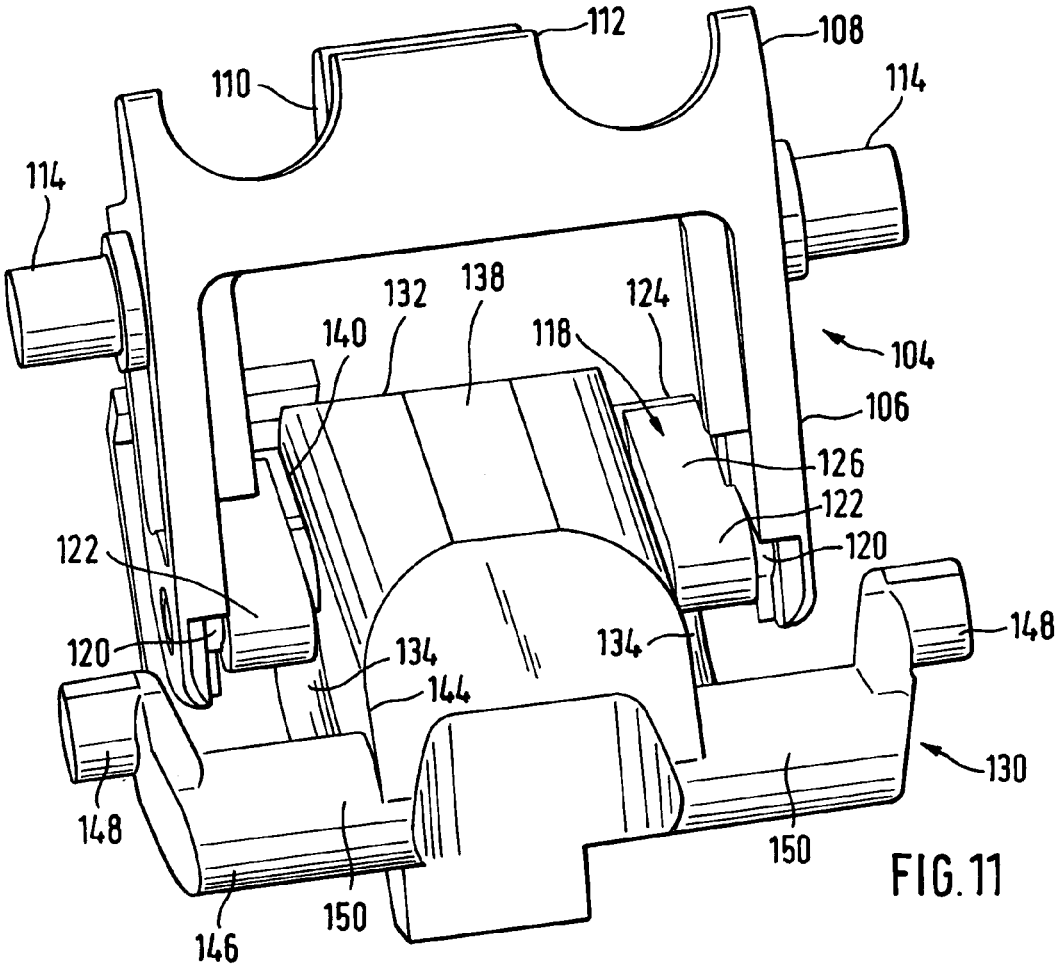
FIGS. 11 and 12 are perspective views of the embodiment of FIG. 10*b*.
Figure 12:
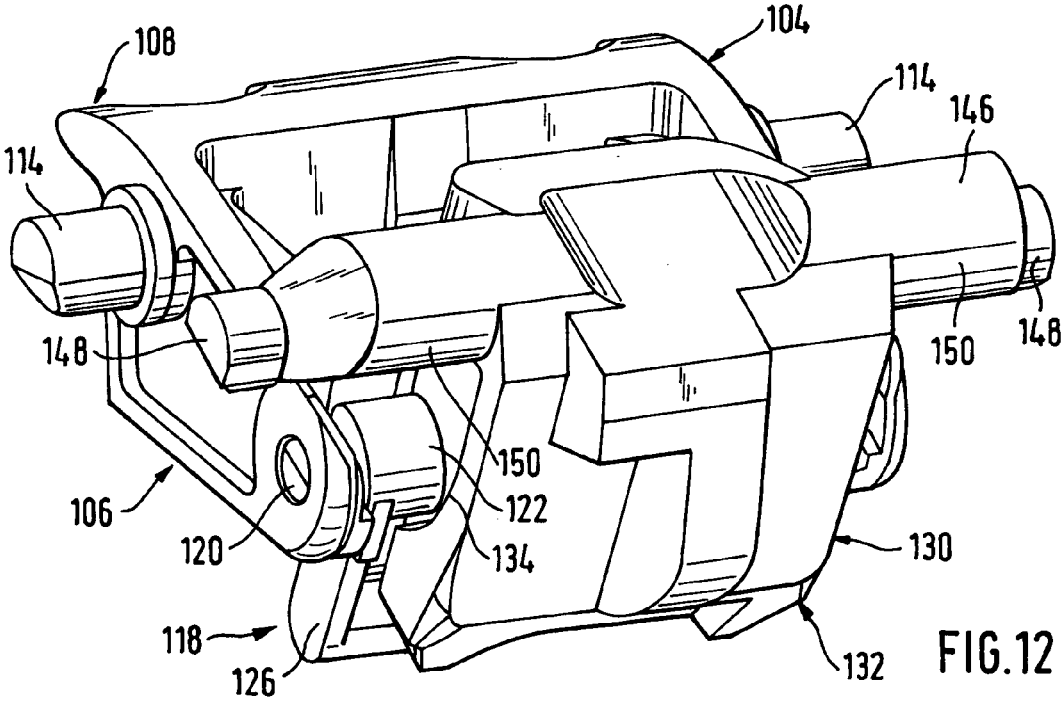

The door lock illustrated in FIGS. 10 to 12 comprises a frame 100, in which two parallel side walls 102 are provided for mounting various axle journals.

A closing lever 104 is constructed as a two-arm lever and comprises a steering arm 106 and a latch arm 108 pointing approximately in the opposite direction to the steering arm 106. One end of the latch arm 108 is forked in the shape of a latch with a locking nose 110 and a closing nose 112.

The steering arm 106 of the closing lever 104 is formed by two parallel partial arms constructed in mirror-image fashion, which are connected to one another by the latch arm 108, so that an open, U-shaped frame is formed.

Two axle journals 114 of the closing lever 104 engage in each case in bearing bores, not shown in the drawings, of the side walls 102 and allow for a pivotable mounting of the closing lever 104 about an (imaginary) pivot axis 116.

A steering rod 118 is constructed as a U-shaped crank. It comprises two lateral axle journals 120, two cylindrical rolling surfaces 122, a crankpin 124 and two lateral cheeks 126, which each connect one end of the crankpin 124 to an axle journal 120. The ends of the crankpin which are each connected to the axle journals 120 are rounded and form the rolling surfaces 122. The axle journals 120 engage in each case in a bearing bore, in each case in the vicinity of one end of the partial arms of the steering arm 106, where they are pivotably mounted. A pivot axis 128 (which is imaginary and is displaced with a pivoting movement of the closing lever 104) of the steering rod 118 extends through both axle journals 120.

A tensioning lever 130 comprises a hollow, tubular guide arm 132 with a cross section in the form of a square with rounded corners. Constructed along the guide arm 132 on both sides is a projection, which in each case forms a sliding surface 134 for the rolling surfaces 122. An end 138 of the guide arm 132 remote from a pivot axis 136 comprises a groove guide 140, which is formed by two recesses arranged in each case in a lateral surface of the guide arm 132 and extending approximately perpendicular to the pivot axis 136. The crankpin 124 of the steering rod 118 engages in the groove guide 140 and can execute both a rotary and a longitudinal movement therein.

A spring 142 constructed as a helical compression spring is tensioned in the tubular interior of the guide arm 132 between one end 144 and the crankpin 124 of the steering rod 118.

The end 142 of the guide arm 132 extends into an operating arm 146 of the tensioning lever 130, at whose lateral ends an axle journal 148 is arranged in each case. The axle journals 148 engage in each case in a bearing bore, not shown here, in the side walls 12 of the frame 10 where they are rotatably mounted.

The operating arm 146 of the tensioning lever 130 engages with sliding surfaces 150 in each case in a recess 152 of an operating device 154, which engages by means of two axle journals 156 in each case in a bearing bore in the side walls 12 of the frame 10.

A closing fitting 158 of an electrical household appliance comprises a closing journal 160, which can engage in the latch formed by the locking nose 110 and the closing nose 112, so that the door is locked.

In the perspective views of FIG. 11 and FIG. 12, the closing lever 104, the steering rod 118 and the tensioning lever 130 are each illustrated in the closed position of the lock according to FIG. 10*b*. In this respect, FIG. 12 is a view approximately in the direction of the arrow A in FIG. 10*b*, whilst FIG. 13 is a view approximately in the direction of the arrow B.

In order to explain the method of operation of this door lock, reference is made here to DE 195 40 843 C2.

In order to obtain force ratios comparable to the door lock described above, in which the forces required for a transition from the closed position to the open position and the forces required for a transition from the open position to the closed position essentially correspond, roller bearings, anti-friction bearings or the like are arranged between the axle journals 114 of the closing lever 104 and the corresponding bearing bores of the side walls 102. Alternatively or in addition, bearings of this type are used between the axle journals 148 of the tensioning lever 130 and the corresponding bearing bores of the side walls 12. Additional optimisation is obtained if the lateral axle journals 120 of the steering rod 118 are pivotably arranged in the bearing bores of the partial arms of the steering arm 106 by means of bearings.

Since the crankpins 124 of the steering rod 118 also execute rotary movements in the groove guide 140 of the tensioning lever 130, frictional forces occurring at this location are reduced if bearings of a suitable type are fitted to the crankpins 124. The use of bearings between the axle journals 156 of the operating device 154 and corresponding bearing bores of the frame 100 also represents an optimisation.

The invention claimed is:

1. An appliance door latch for retaining a striker member, the latch comprising:

a latch frame affixable to a portion of the appliance;

a carrier member held by the latch frame to move between first and second positions;

a spring biasing the carrier member toward the second position;

a gripping member supported on the carrier member to move with the carrier member and rotate independently with respect to the carrier member about a rotational axis, the gripping member rotating to capture a portion of the striker member in a capture position when the striker member enters an opening formed in the gripping member and rotating to release the striker member in a release position when the striker member exits the opening;

a stop device cooperating with the gripping member to hold the carrier member in the first position with the spring in a high state of inner tension when the gripping member is in the release position and to release the canier member to the second position with the spring in a lower state of inner tension when the gripping member rotates to the capture position, the stop device providing a contact portion for rolling contact with the gripping member;

wherein the stop device includes one or more wiling contact, bearings to support the contact portion for rotation with respect to the latch frame; and, wherein the stop device includes a pin forming the contact portion at its outer circumferential surface and rotatably supported at its ends by rolling contact bearings.

* * * * *

UNITED STATES PATENT AND TRADEMARK OFFICE

CERTIFICATE OF CORRECTION

PATENT NO. : 7,210,711 B2
APPLICATION NO. : 09/993200
DATED : May 1, 2007
INVENTOR(S) : Albert Dirnberger and Georg Spiessl It is certified that error appears in the above-identified patent and that said Letters Patent is hereby corrected as shown below:

In column 12, line 44, please change “wiling” to --rolling--.

In column 12, line 45, please change “contact,” to --contact--.

Signed and Sealed this

Twenty-third Day of October, 2007

JON W. DUDAS
*Director of the United States Patent and Trademark Office*